United States Patent [19]

Vandervort et al.

[11] Patent Number: 4,563,154

[45] Date of Patent: Jan. 7, 1986

[54] TRACING STENCIL TABLET

[75] Inventors: James W. Vandervort, Winchester, Mass.; Wim Hartevelt, Baarle-Hertog, Belgium

[73] Assignee: S.D.V. Incorporated, Winchester, Mass.

[21] Appl. No.: 580,895

[22] Filed: Feb. 16, 1984

[51] Int. Cl.[4] ..... B43L 13/20

[52] U.S. Cl. ..... 434/87; 33/565

[58] Field of Search ..... 33/562, 563, 564, 565; 434/87

[56] References Cited

U.S. PATENT DOCUMENTS

| | | | |
|---|---|---|---|
| 2,500,873 | 3/1950 | Sager | 33/563 |
| 2,950,537 | 8/1960 | Fixen | 434/87 X |
| 3,119,188 | 1/1964 | Orndorff | 33/565 |
| 3,557,463 | 1/1971 | Perry | 33/565 |
| 3,861,066 | 1/1975 | Klaja | 434/87 |

FOREIGN PATENT DOCUMENTS

| | | | |
|---|---|---|---|
| 56979 | 8/1982 | European Pat. Off. | 434/87 |
| 727235 | 3/1932 | France | 33/565 |
| 384919 | 12/1932 | United Kingdom | 434/87 |

*Primary Examiner*—Harland S. Skogquist

*Attorney, Agent, or Firm*—Cesari and McKenna

[57] ABSTRACT

A drawing stencil tablet to aid a child to color and draw includes a planar stencil plate having interior openings defining tracing edges that outline a character or shape. A plurality of spaced-apart locating posts project down from an edge of the plate and engage in registering openings in a stiff planar base when the plate is placed flush against an interior area of that base so that a base margin extends all around the plate. When the locating posts are received in the base, movement of the plate relative to the base is prevented so that a child can trace or draw on a sheet of paper sandwiched between the base and the plate with assurance that the position of the stencil plate on the paper will remain fixed.

14 Claims, 3 Drawing Figures

TRACING STENCIL TABLET

This invention relates to a learning and guidance device to aid small children to discern the shapes of different objects and characters and to aid them to draw, trace and color such objects and characters. It relates more particularly to a tracing stencil tablet which is particularly simple and easy to use.

BACKGROUND OF THE INVENTION

Children begin learning at a very early age and it is important for the learning process that a child be motivated by success in his or her various learning efforts and activities. In the course of his or her early development, a child invariably attempts to draw pictures with a pencil or crayon. Although most children are able to perceive and discern different forms and shapes at a very young age, e.g. eighteen months, many of them do not yet possess sufficient fine motor control to enable them to draw. Indeed, the inability of such children to manipulate their untrained hands to direct a pencil or crayon to reduce a form or shape in their heads to paper is a source of considerable frustration to such children.

Over the years, considerable effort has been devoted to providing various learning and teaching devices to assist children to draw. These devices have included tracing guides, stencils, templets and the like. Examples of such drawing aids are disclosed in U.S. Pat. Nos. 148,291; 2,293,696; 3,633,286 and 3,861,066. However, the prior drawing aids of this general type typified by those in the above patents, have not been entirely satisfactory. Some are overly complex and expensive. Some demand excessive manual dexterity on the part of the child to properly position and use the particular device and, with most, no provision is made for containing or storing the device with the result that its parts become separated and lost.

SUMMARY OF THE INVENTION

Accordingly, the present invention aims to provide an improved teaching device to assist a small child to draw, trace and color.

Another object of the invention is to provide a tracing stencil tablet that enables a child with untrained hands to draw and color pictures accurately.

A further object of the invention is to provide a tracing stencil tablet which is easy to use and does not frustrate the child.

Still another object of the invention is to provide a tracing stencil tablet which is simple and economical to manufacture.

Another object of the invention is to provide such a tablet which is especially adapted to be contained in a standard ring-type binder.

Yet another object of the invention is to provide a tablet of this type which can also provides a frame support for the child's picture or tracing after that is completed.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my drawing stencil tablet is designed to be used by small children, e.g. ages fifteen months to two years, to assist them to trace, draw and color pictures of different characters and figures and to assist them to learn to distinguish between such characters and figures. The tablet comprises a base made of a relatively stiff material such as cardboard for supporting a multiplicity of standard size sheets of paper. Holes are punched through at least one margin of the base some of which enable the base to be retained in a ring-type standard binder.

The remaining component of the tablet is a stencil plate arranged and adapted to be positioned flush against the upper surface of the base. The plate includes a frame or border whose shape more or less corresponds to that of the base. The dimensions of that frame are selected so that, when the plate is positioned properly on the base, the frame edges are disposed inwardly from the corresponding edges of the base. Resultantly, marginal areas of the base extend all around the frame. Formed integrally with the plate frame are a multiplicity of guide ribs or webs which extend between the frame edges and each other so as to define a plurality of shaped openings within the frame. These openings, in turn, define in their totality the outlines of different characters or figures or of different parts of the same character or figure.

A plurality of integral locating prongs or posts project from the rear face of the plate. These posts are dimensioned and located on the plate so that, when the plate is centered on the base, the posts register with at least some of the marginal holes punched in the base. Thus when the plate posts are received in the base holes, the location of the plate on the base is fixed firmly.

As noted previously, the base supports paper sheets. Therefore, when such sheets are positioned on the base under the stencil plate, the plate can be pressed against the base so that its locating posts or prongs penetrate the paper as the posts seat in their holes in the base thereby fixing the paper and the stencil plate to the base. To facilitate such penetration, the paper sheets can be prepunched with holes which register with the holes in the base. Also, the paper sheets may be blank, or be preprinted with lines corresponding to the lines or shapes defined by the stencil plate.

To use the drawing stencil tablet, a child places the stencil plate flush against the uppermost sheet of paper positioned on the base. Since the plate and base are similarly shaped, it is relatively easy for the child to position the plate on the base so that the plate's locating posts can be pushed through the paper sheets and engage in the base holes. With the plate and paper fixed thusly, the child can grasp a pencil or crayon and move that drawing instrument along the various guide ribs in the stencil plate to trace the character defined by the plate and/or to color the areas defined by the plate on the uppermost paper sheet on the base. As will be seen in greater detail later, the plate guide ribs are shaped to account for the shape of the working end of the drawing instrument and the angle at which the instrument is usually held by the child to make it easier for the child to follow the ribs accurately and closely.

At any point in the process, the child can stop and remove the stencil plate from the base to check his or her progress with the drawing on the paper. When the plate is repositioned on the base by re-engaging the plate posts through the holes in the paper sheets into the base holes, the plate is assuredly returned to its original location on the base relative to the paper so that the child can proceed with assurance that the new lines or colored areas drawn on the paper will be in proper alignment with those previously formed.

When the child has completed a color drawing of the figure defined by the stencil plate, he or she can remove the plate to retrieve the finished drawing. If, on the other hand, the child has simply made a tracing by following the guide ribs of the stencil plate, after removal of the plate, the child can color freehand the various areas enclosed by the lines traced on the paper sheet.

In either event, the child may fill in the areas to be colored with any combination of colors at hand so that the resultant color drawing is solely a product of the child's own imagination and whim. Consequently, the picture created by the child on the paper will be an accurate representation of the picture or character defined by the stencil plate colored to suit the child. Therefore, through the use of the present tablet, the child should be able to produce finished drawings of characters and figures which are easily recognizable to the child and which therefore should be a source of satisfaction to the child. The stencil plate component of the tablet can even be used as a frame for supporting and displaying such finished drawings.

The base and paper sheet components of the tablet are of more or less conventional items which can be made relatively inexpensively. The stencil plate can be a simple molded plastic part which is also inexpensive to make in quantity. Therefore, the drawing stencil tablet as a whole is a relatively low cost item which should find wide acceptance in the marketplace.

BRIEF DESCRIPTION OF THE DRAWING

For a fuller understanding of the nature and objects of the invention, reference should be had to the following detailed description, taken in connection with the accompanying drawing, in which.

DETAILED DESCRIPTION OF THE PREFERRED EMBODIMENT

Figure 1:
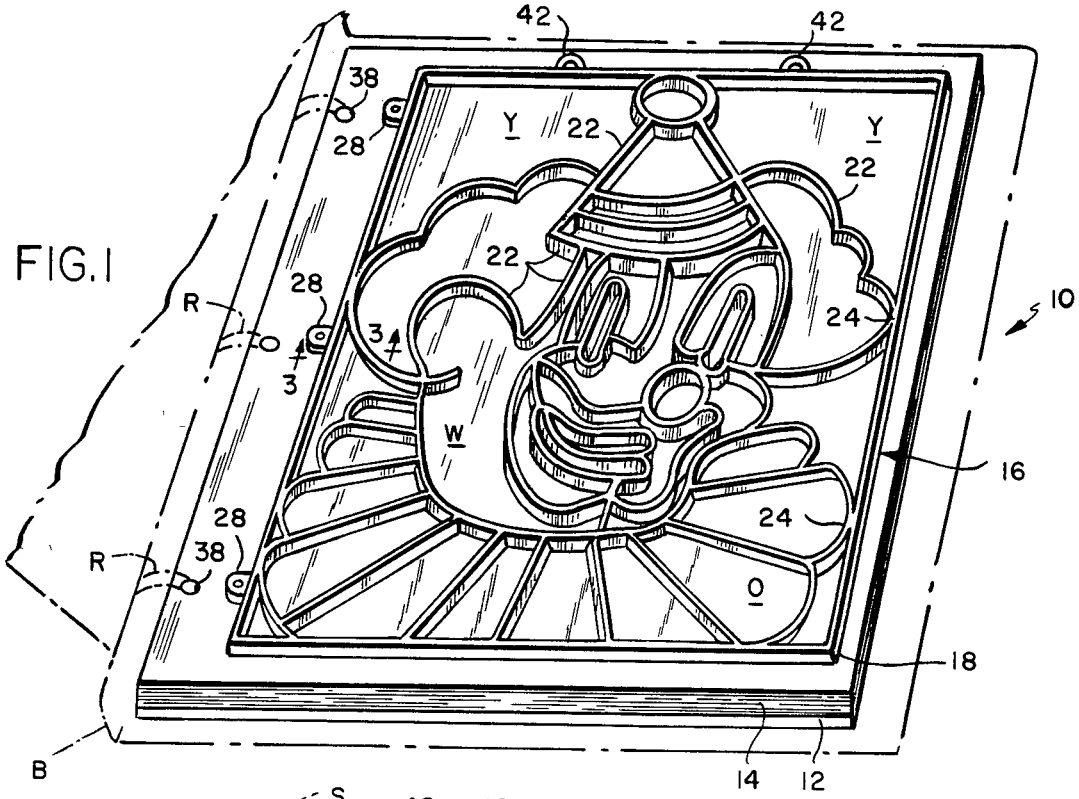
FIG. 1 is a perspective view of a drawing stencil tablet embodying the principles of this invention.

Referring to FIG. 1 of the drawing, the drawing stencil tablet of this invention, indicated generally at 10, comprises a rectangular base or back 12 made of relatively thick cardboard or similar stiff material for supporting a multiplicity of paper sheets 14. Base 12 has a white skin coat on its top and bottom surfaces to present a finished appearance and instructions for use and/or advertising text can be printed on the bottom of the base. If desired, the sheets 14 and base 12 may be unconnected or be releasably secured together along one edge by conventional means such as an adhesive film (not shown) to form a pad. The base and paper sheets are preferably of a standard size such as $8\frac{1}{2}\times 11$ and the sheets may be lined or unlined, as desired.

Tablet 10 also includes a stencil plate 16, preferably molded of a suitable impact-resistant plastic such as polyethylene or polypropylene. The plate has more or less the same shape as base 12, but is somewhat smaller than the base so that the plate can be positioned within an inside or interior area of the base as shown in FIG. 1. Thus, the illustrated plate 16 includes a generally rectangular boundary or frame 18 having an upper end segment 18*a*, a lower end segment 18*b* and a pair of left and right side segments 18*c* and 18*d* respectively. In the illustrated example wherein base 12 is a standard $8\frac{1}{2}\times 11$ size, frame 18 is typically 10 inches long and $7\frac{1}{2}$ inches wide and, as shown in FIG. 3, each segment thereof is about $\frac{1}{8}$ inch high and is slightly tapered.

The stencil plate 16 also includes a multiplicity of guide webs or ribs 22 extending within frame 18. Various of these ribs join each other and some of them join frame 18 at joints or boundaries 24 so that together the ribs define one or more characters or figures within the area of frame 18. Thus, in the stencil plate embodiment specifically illustrated in the drawing, ribs 22 define the outline of a clown's head and torso centered within frame 18. Of course, in other stencil plates, ribs 22 may be arranged and dimensioned to define another character or figure or a plurality of different characters or figures within the frame. Typically, the ribs are triangular in cross section as best seen in FIG. 3, having a base length and height of about $\frac{1}{8}$ inch. This rounding or beveling of the ribs makes it easier for a child to use the tablet as will be described later.

Figure 2:
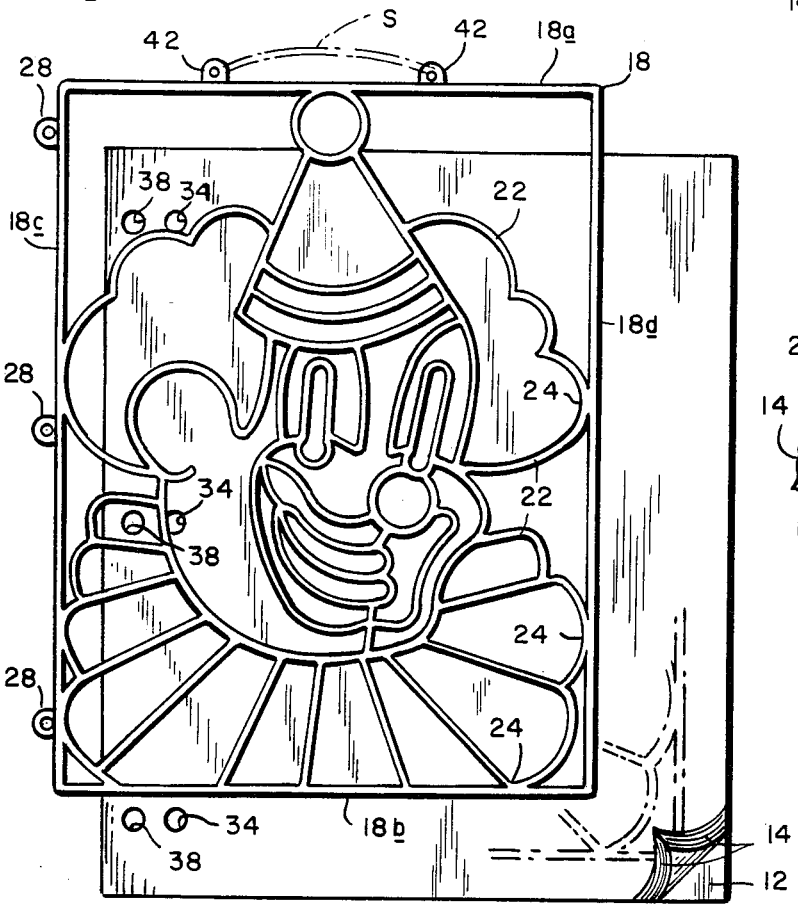
FIG. 2 is an exploded perspective view on a smaller scale of the FIG. 1 tablet.
Figure 3:
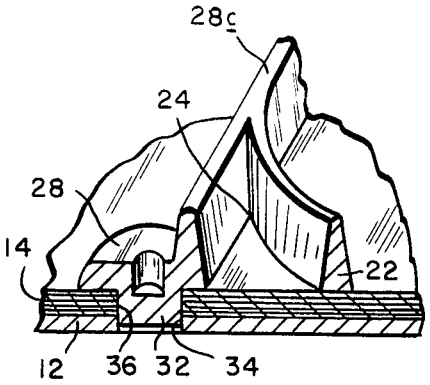
FIG. 3 is a fragmentary sectional view taken along line 3—3 of FIG. 1.

As best shown in FIGS. 2 and 3, the stencil plate 16 is formed with a series of three spaced-apart integral ears or tabs 28 which extend outwardly from one segment of the frame, say side segment 18*c*. Extending down from each tab 28 is a short, generally cylindrical integral post or prong 32. When the stencil plate is properly positioned on base 12, these posts are arranged to engage in a corresponding series of spaced-apart holes 34 punched through the left margin of base 12, passing also through the paper sheets 14 positioned on base 12. Accordingly, the diameters of posts 32 are only slightly less than the diameters of holes 34 and the post lengths are such that, when the stencil plate is placed flush against the sheets 14 on the base and pressed down on the base, the posts project through the sheets into the base holes 34, thereby fixing the positions of the stencil plate 16 and sheets 14 relative to base 12. Preferably, the diameter and placement on base 12 of holes 34 are the same as the diameter and placement of the three holes in a sheet of notebook paper designed to mount in a standard three-ring binder and the posts 32 are correspondingly positioned on frame 18.

While we have specifically illustrated the locating posts 32 as being placed outboard of the plate frame 18, those posts could just as well depend from tabs disposed inboard of the frame or depend directly from a frame segment. Also, of course, the locating posts 32 could extend from another part of the frame such as right side segment 18*d*, in which case, the holes 34 punched in base 12 would be relocated accordingly. As noted previously, paper sheets 14 may be punched with holes 36 which register with base holes 34 to facilitate penetrating those sheets when the stencil plate is engaged to the base.

The tablet 10 can be arranged to be stored or carried in a notebook or binder. For this, a second series of vertically spaced-apart holes 38 are punched in the left margin of base 12. If paper sheets 14 are connected to base 12 and those sheets are the same width as the base, those holes would also extend through sheets 14. The base 12 and any paper sheets 14 thereon could then be engaged on the rings R of a standard three-ring binder B as shown in dotted lines in FIG. 1.

A child can use tablet 10 while it is contained in binder B or the tablet can be removed from the binder.

In either event, if one or more paper sheets 14 are not already positioned on base 12 under the stencil plate 16, the stencil plate is removed from the base and at least one sheet is positioned on the base with its edges more or less even with the corresponding edges of the base. This automatically positions the paper sheet holes 36 (if present) in register with the base holes 34 so that, when the stencil plate is placed flush on the base, its locating pins 32 will engage easily in the holes 34 and 36 thereby locking the stencil plate and paper to the base. The child can then draw or color the character defined by the stencil plate onto the topmost sheet of paper by moving the point of the pencil, crayon or other drawing instrument over the paper using the plate frame 18 and ribs 22 as guides.

As best seen in FIG. 3, the guide ribs 22 are tapered to complement the usual taper of the writing instrument so that the pointed end of the pencil or crayon can easily follow those ribs right into the narrow nooks and crannies where they connect to each other and to frame 18 at joints 24. Consequently, even a very small child can produce an accurate and complete drawing or tracing of the picture defined by the stencil plate, in this case, a clown figure.

At any point in the drawing or coloring process, the child can stop and later resume his efforts with assurance that there will be no relative movement of the stencil plate relative to the paper sheet being drawn upon that could spoil the drawing. The child can even remove the stencil plate from the paper to inspect the drawing. When he or she repositions the plate on the pad with the locating posts 32 in the holes 34 and 36, the plate will assuredly have been returned to its original position so that there will be no discontinuities or gaps between the original lines or colored areas of the drawing and any new lines made on the paper.

As the child completes the drawing of the clown on the uppermost paper sheet 14, some areas of the drawing may be colored yellow (Y) and others colored orange (0), white (W), etc. as indicated in FIG. 1. Since the stencil plate 16 remains locked in place, the crayons or colored pencils manipulated by the child will be guided by the plate so that there will be no overlapping of the different colored areas of the drawing. Therefore, when all of the areas within frame 18 have been filled in or colored and the stencil plate 16 removed from the base, the uppermost sheet of paper 14 on the base should carry a finished drawing of relatively high quality and one with which the child can take some pleasure and satisfaction. It is important to note that the stencil plate is positioned on an interior area of the uppermost paper sheet 14 and of base 12. A paper sheet border or margin extends all around the plate outside frame 18. That margin can be colored or filled in as desired to form a distinctive frame all around the drawing inscribed on the paper.

Since the stencil plate frame segments 18*a* to 18*d* and guide ribs 22 do have definite widths, e.g., one-eighth inch, the portions of the paper sheet that were underneath the frame and ribs when the drawing was made will not be shaded or colored. Therefore, after the stencil plate is removed from the drawing, those blank segments can be filled in as desired. Alternatively, the paper sheets 14 may be preprinted with the outlines formed by the frame and ribs of stencil plate 16, a small segment of such a printing being indicated in phantom at 16′ in FIG. 2.

If a particular child has sufficient manual dexterity, instead of using tablet 10 as a guide to complete a colored drawing, that child may use the stencil plate only to trace an outline of the stencil plate frame and ribs on the uppermost sheet of paper on base 12. In this case, the child moves the tip of an ordinary pencil or ballpoint pen over the paper along frame 18 and ribs 22. The bevel or taper of ribs 22 allows the child to direct the pointed tip of the writing instrument right against the boundaries of the stencil plate and paper so that an accurate, high quality tracing of the stencil plate can be made on the paper sheet 14. The child can then remove the stencil plate from the base and color freehand the various areas on the paper defined by the tracing, a clown in this example. The border area of the paper outside the tracing may also be filled in if desired to form a frame for the drawing. Thus it is clear that the present tablet 10 is a useful teaching device for children having a relatively wide range of capabilities.

The stencil plate 16 component of tablet 10 can even be used as a frame or hanger to mount a drawing created by the child. As noted previously, the stencil plate's locating posts 32 achieve a relatively tight fit with the holes 36 in the paper sheets 14. Accordingly, when the plate and paper sheet with the drawing on it are removed from base 12, the paper will remain impaled on the plate posts with the figure defined by the stencil plate in register with the drawing on the paper. A pair of spaced-apart eyes 42 extend out from the upper end segment 18*a* of the plate frame. A length of string indicated in dotted lines at S in FIG. 2 can be secured between those eyes to facilitate hanging the stencil plate and the attached drawing from an appropriate picture hook or tack in a wall or window frame.

Of course, when the child is through with the tablet 10, the stencil plate can be re-engaged to the base 12 with any remaining paper sheets 14 being sandwiched between those components and the tablet stored in a safe place such as the three-ring binder B (FIG. 1). With reasonable care, then, even though it is made of inexpensive parts, the tablet 10 should have a relatively long useful life.

It will thus be seen that the objects set forth above, among those made apparent from the preceding description, are efficiently attained. Also, certain changes may be made in the above construction without departing from the scope of the invention. For example, while the stencil plate 16 composed of the rectangular frame 18 and ribs 22 is mostly open, the plate could just as well have filled-in areas so that the drawing made using the plate would have relatively large open spaces between the filled-in or colored areas of the drawing. Also, since the posts 32 on the stencil plate and their receiving holes 34 on base 12 have the same vertical spacing as paper used in a standard three-ring binder or notebook, standard $8\frac{1}{2} \times 11$ three-hole notebook paper could be used in the tablet in lieu of the illustrated paper sheets 14 which are punched with six holes instead of the usual three. Of course, in that event, the base 12 and stencil plate 16 would be stored together in binder B separate from the regular three-hole paper therein. Therefore, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A drawing stencil tablet comprising

A. relatively rigid planar stencil plate, said plate including (1) a first set of edges extending around its periphery;

(2) means defining one or more interior openings that form a second set of edges which outline one or more characters or shapes; and (3) a plurality of spaced-apart locating means projecting from the plate adjacent edges of said first set of edges and extending perpendicular to the general plane of the plate;

B. a relatively stiff planar base, said base being geometrically similar to said stencil plate but of larger area so that the plate can be placed flush against an interior area of the base with a base margin extending all around the plate; and C. means defining a plurality of spaced-apart holes in the base, said holes being in register with and adapted to snugly receive, the plate locating means when the plate is against said base interior area so as to prevent movement of the plate parallel to the base.

2. The tablet defined in claim 1 wherein said plate comprises

A. a generally rectangular frame which forms said first set of edges; and

B. a plurality of guide ribs extending within said frame, said ribs being connected to each other and to the frame so as to form said second set of edges.

3. The tablet defined in claim 2 wherein said locating means are spaced apart along one edge of the frame.

4. The tablet defined in claim 3 wherein each said rib has a cross section which inclines or tapers so that the rib is narrower at its top than at its bottom.

5. The tablet defined in claim 3 wherein the locating means are short posts formed integrally with the frame.

6. The tablet defined in claim 5 and further including means defining a pair of eyes spaced apart along an edge of the frame.

7. The drawing stencil tablet defined in claim 3 and further including one or more paper sheets, said sheets A. having substantially the same dimensions as said base; and B. being sandwiched between said plate and said base in registration with said base so that, when said locating means are received in the base holes, they penetrate said sheets.

8. The drawing stencil tablet defined in claim 7 and further including means defining a plurality of spaced-apart holes in said paper sheets which are aligned with said plurality of holes in said base when said sheets are in registration with said base.

9. The drawing stencil tablet defined in claim 8 and further including markings on the upper surfaces of said plurality of sheets, said markings being in registration with said guide ribs when said stencil plate is positioned against said interior area of the base.

10. The drawing stencil tablet defined in claim 1 and further including means defining a series of spaced-apart holes extending through the base parallel to one edge thereof.

11. The drawing stencil tablet defined in claim 10 wherein the holes of said plurality of holes are located inboard on the base from and adjacent to, the holes of said series of holes through said base.

12. The drawing stencil tablet defined in claim 11 wherein the spacing of the holes in said plurality of holes and in said series of holes correspond to the spacing between the rings of a standard ring binder.

13. The drawing stencil tablet defined in claim 9 wherein

A. said base is a sheet of relatively thick cardboard; and

B. said stencil plate is a unitary molded plastic part.

14. The drawing stencil tablet defined in claim 13 and further including one or more paper sheets, said sheets A. having substantially the same dimensions as said base; and B. being sandwiched between said plate and said base in registration with said base so that, when said locating means are received in the base holes, they penetrate said sheets.

* * * * *